United States Patent [19]

Nakamura et al.

[11] 4,363,620

[45] Dec. 14, 1982

[54] FIRE EXTINGUISHING DEVICE FOR OIL BURNER

[75] Inventors: Kazuharu Nakamura, Nagoya; Yutaka Nakanishi, Kounan; Toshihiko Yamada, Toyoake, all of Japan

[73] Assignee: Toyotomi Kogyo Co., Ltd., Nagoya, Japan

[21] Appl. No.: 211,972

[22] Filed: Dec. 1, 1980

[51] Int. Cl.[3] ..... F23H 5/00

[52] U.S. Cl. ..... 431/33; 431/88; 431/144; 431/307

[58] Field of Search ..... 431/33, 34, 88, 144, 431/307

[56] References Cited

FOREIGN PATENT DOCUMENTS 49-47225 12/1974 Japan .
52-18736 4/1977 Japan .
54-37473 11/1979 Japan .
55-48011 11/1980 Japan ..... 431/307

*Primary Examiner*—Carroll B. Dority, Jr.
*Attorney, Agent, or Firm*—Pollock, Vande Sande & Priddy

[57] ABSTRACT

A fire extinguishing device for an oil burner capable of instantaneously and surely accomplishing the fire extinguishing with ease and without generating any bad odor. A wick receiving chamber has a width larger than the thickness of a wick received therein and an air chamber communicated to the wick receiving chamber is disposed adjacent thereto. The air chamber is adapted to be communicated to an ambient atmosphere during the combustion operation and to be shut off therefrom by means of a valve. The fire extinguishing of an oil burner is accomplished by utilizing an air stored in the air chamber.

5 Claims, 4 Drawing Figures

FIRE EXTINGUISHING DEVICE FOR OIL BURNER

BACKGROUND OF THE INVENTION

1. Field of the Invention

This invention relates to a fire extinguishing device for an oil burner and more particularly to a device capable of instantaneously and surely accomplishing the fire extinguishing of an oil burner such as an oil space heater or the like only by lowering a wick of the oil burner.

2. Description of the Prior Arts

Conventionally, the fire extinguishing operation of an oil burner such as an oil space heater or the like has been generally conducted in such a manner that a wick of the burner is lowered into a wick receiving chamber thereof to gradually reduce the generation of vapor of fuel oil such as kerosene from the wick and to gradually reduce flames, to thereby allow the fire extinguishing of the oil burner as long as 100 to 250 seconds. Such conventional fire extinguishing operation has been widely used because it allows fuel oil vapor remaining in a wick receiving the chamber to be perfectly burned, to thereby substantially reduce the generation of bad odor from fuel oil vapor during the operation. However, such conventional operation does not permit the fire extinguishing of an oil heater as short as ten seconds in an emergency such as an earthquake.

Two devices have been conventionally employed which instantaneously accomplish the fire extinguishing of an oil burner by lowering a wick into a wick receiving chamber. One of such conventional devices is disclosed in Japanese Utility Model Publication No. 47225/1974. The device disclosed in the Japanese utility model publication is constructed to instantaneously conduct the fire extinguishing operation of an oil burner by means of an air introduced into a wick receiving chamber through small holes which are provided around the outer wall portion of the wick receiving chamber above an upper end of a wick lowered into the wick receiving chamber, the wick receiving chamber being communicated through the small holes to an ambient atmosphere when the wick is lowered into the receiving chamber. During the combustion operation, an air is not substantially introduced through the holes into the wick receiving chamber, because the wick substantially closes the holes; thus, the existence of the small holes does not adversely affect the combustion of fuel oil in a combustion chamber positioned above the wick receiving chamber. When the wick is lowered into the wick receiving chamber in order to conduct the fire extinguishing operation, an air is introduced through the small holes into the upper space portion of the wick receiving chamber to form an air phase between the vapor phase of fuel oil generated from the wick lowered into the lower portion of the wick receiving chamber and flame within the combustion chamber. Thus, the air phase interrupts the communication between the flame and the fuel oil vapor to accomplish the fire extinguishing of the oil burner. However, such conventional device has a disadvantage of generating bad odor because a gas of a high temperature within the combustion chamber goes up through the chamber to cause an air to be introduced through the small holes into the combustion chamber, so that fuel oil vapor adjacent to the wick is carried on the air to the combustion chamber of a high temperature and is subjected to thermal decomposition. An additional disadvantage encountered with such conventional device is that fuel oil vapor within the combustion chamber ignites outside the oil burner by outwardly leaking from the small holes, or a great volume of air is introduced through the small holes into the combustion chamber to lower a temperature of the combustion chamber and to cause fuel oil to be burned in the portion of the combustion chamber adjacent to the wick receiving chamber; so that an oil tank of the burner or the wick receiving chamber is heated to a high temperature.

The other conventional device is disclosed in Japanese Utility Model Publication No. 18736/1977 which instantaneously accomplishes the fire extinguishing of an oil burner. Such conventional device is constructed in such a manner to blow out a wick by means of a blast generated due to the ignition of fuel oil vapor stored in a preliminary chamber provided around a wick receiving chamber immediately after the wick has been lowered into the wick receiving chamber, to thereby instantaneously achieve the fire extinguishing of an oil burner. In such device, the flame of the wick is drawn into a gap between inner and outer walls of the wick receiving chamber when the wick is lowered, and then, the flame ignites and explodes the oil vapor within the preliminary chamber to produce a great volume of pressurized gas. The pressurized gas jets from the preliminary chamber through small holes provided at the preliminary chamber to the gap between the inner and outer walls of the wick receiving chamber to expel the flame of the wick, to thereby accomplish the fire extinguishing of the oil burner. However, such conventional device has a disadvantage of generating bad odor, because unburned fuel oil vapor and undecomposed gas contained in the jetting gas produced due to the explosion of fuel oil vapor within the preliminary chamber are introduced into the combustion chamber of a high temperature and are subjected to thermal decomposition. In addition, the conventional device has another disadvantage that it is difficult to constantly keep fuel oil vapor within the preliminary chamber in the explosive range; and, when fuel oil vapor within the preliminary chamber is not exploded, it is almost impossible to instantaneously accomplish the fire extinguishing of an oil burner.

BRIEF SUMMARY OF THE INVENTION

The present invention has been made in view of the foregoing disadvantages in the prior arts.

Accordingly, it is an object of the present invention to provide a fire extinguishing device for an oil burner capable of instantaneously and surely accomplishing the fire extinguishing with ease and without generating any bad odor.

It is another object of the present invention to provide a fire extinguishing device for an oil burner capable of compacting the whole oil burner structure.

It is another object of the present invention to provide a fire extinguishing device for an oil burner capable of automatically and instantaneously accomplishing the fire extinguishing in an emergency such as an earthquake or the like.

It is a further object of the present invention to provide a fire extinguishing device for an oil burner which does not cause the leakage of fuel oil when the oil burner falls down.

According to the present invention, there is provided a fire extinguishing device for an oil burner which comprises a wick receiving chamber having a width larger than the thickness of a wick received therein, an air chamber disposed adjacent to the wick receiving chamber and having an opening communicated to the wick receiving chamber, a valve means provided at the air chamber and actuated corresponding to the movement of the wick so as to allow the air chamber to be communicated therethrough to an ambient atmosphere when raising the wick and to allow the air chamber to be shut off from an ambient atmosphere when lowering the wick.

BRIEF DESCRIPTION OF THE DRAWINGS

The above and other objects and features of the invention will be apparent from the following description taken in connection with the accompanying drawings, in which.

DETAILED DESCRIPTION OF THE PREFERRED EMBODIMENTS

Figure 1:
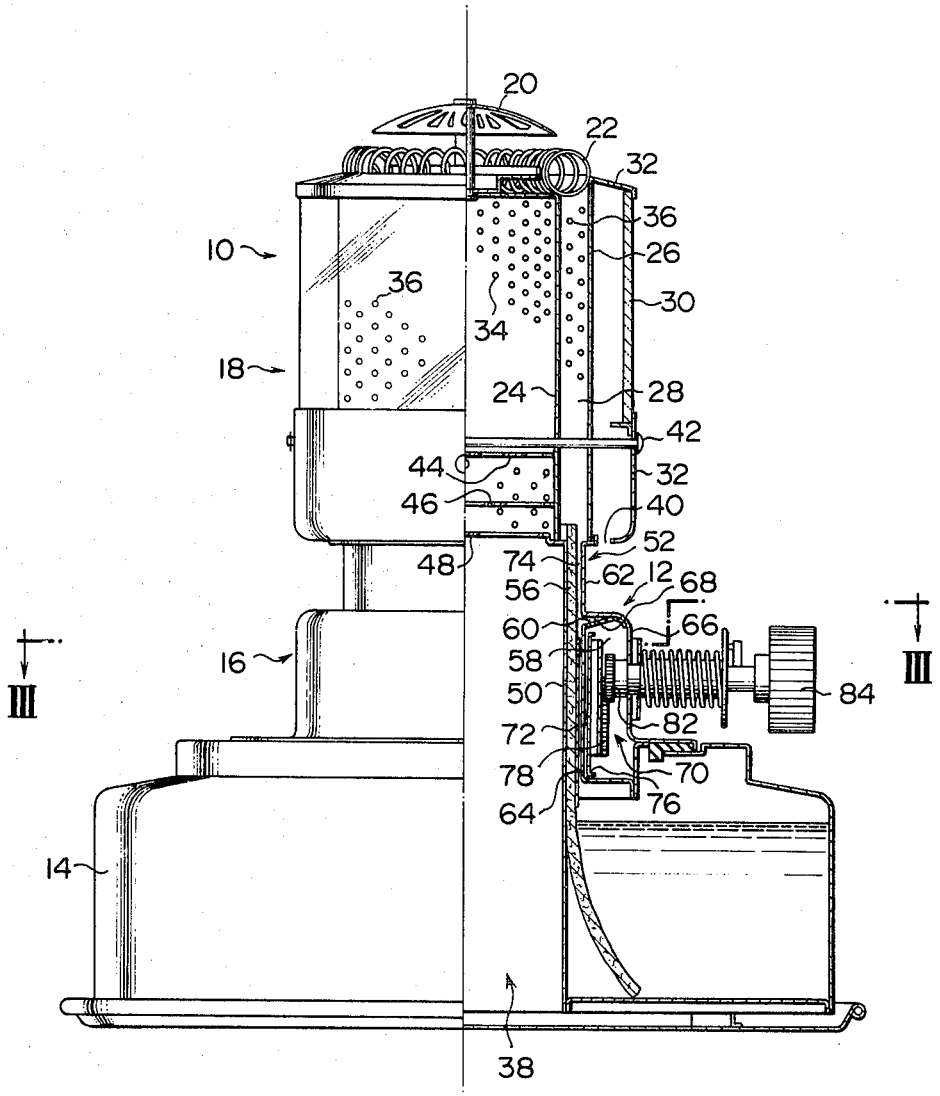
FIG. 1 is an elevational view partly in section schematically showing an oil burner incorporating therein a fire extinguishing device according to the present invention.

Referring first to FIG. 1, there is schematically illustrated an oil burner 10 which incorporates therein a fire extinguishing device 12 according to the present invention. The oil burner illustrated in FIG. 1 is of a type of an oil space heater, however, it should be noted that an oil burner in which a fire extinguishing device of the present invention may be used is not limited to such oil space heater.

The oil burner 10 shown in FIG. 1 is constructed in such a manner as widely known in the art, except the fire extinguishing device of the present invention incorporated therein. The oil burner comprises an oil tank 14 for storing therein fuel oil such as kerosene, a wick receiving cylinder 16 positioned on the tank 14 and a combustion cylinder 18 disposed on the wick receiving cylinder 16. Reference numerals 20 and 22 designate a top plate and a coil, respectively, which are adapted to be heated by flame within the combustion cylinder 18. The combustion cylinder 18 includes cylindrical inner and outer walls 24 and 26 which define a combustion chamber 28 therebetween. Around the outer wall 26 of the combustion chamber is provided a transparent glass cylinder 30 through which radiant heat is outwardly emitted from the combustion chamber 28. Reference numeral 32 designates a retaining means for supporting the glass cylinder 30 at a certain distance with respect to the combustion chamber 28. The inner and outer walls 24 and 26 of the combustion chamber 28 are respectively provided with a lot of small holes 34 and 36 through which a combustion air is introduced into the combustion chamber 28 from the lower portion of an internal cylindrical space 38 and an annular opening 40 provided between the lower portion of the outer wall 26 of the combustion chamber 28 and the lower portion of the retaining means 32, respectively. The combustion cylinder 18 is integrally supported by means of a retaining pin 42. The combustion cylinder 18 is adapted to be separated from the wick receiving cylinder 16 when it is lifted.

Reference numerals 44, 46 and 48 indicate perforated plates which serve to control the flow of a combustion air introduced from the lower portion of the internal space 38 into the combustion chamber 28. For this purpose, holes of the uppermost plate 44 are largest in number and smallest in size, and holes of the lowermost plate 48 are smallest in number and largest in size.

Figure 2:
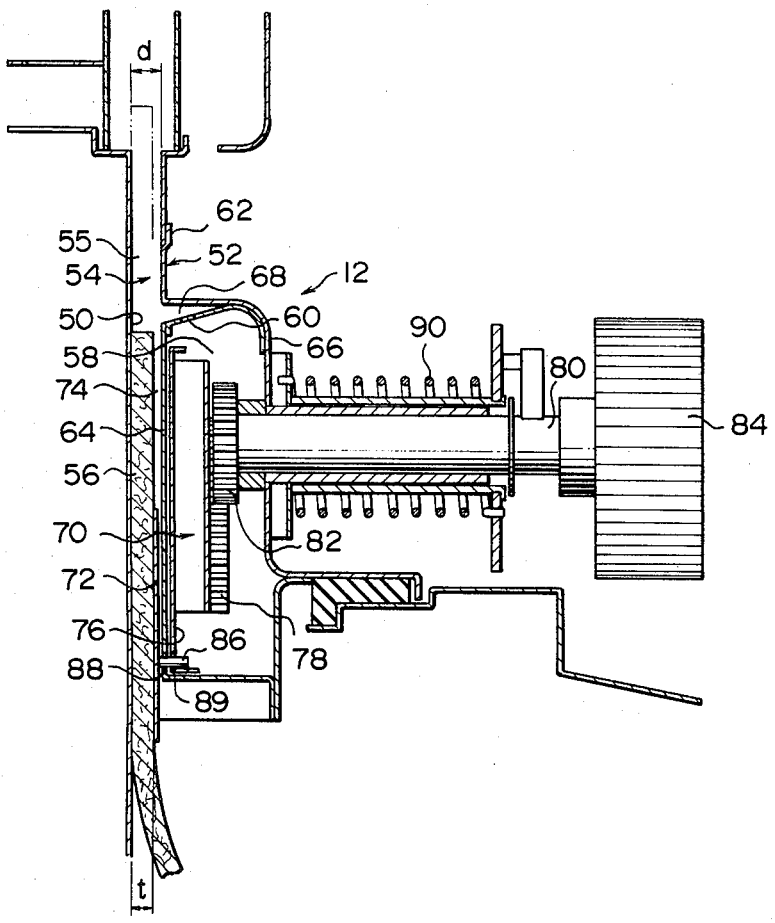
FIG. 2 is an enlarged view showing in detail the fire extinguishing device of the present invention shown in FIG. 1.
Figure 3:
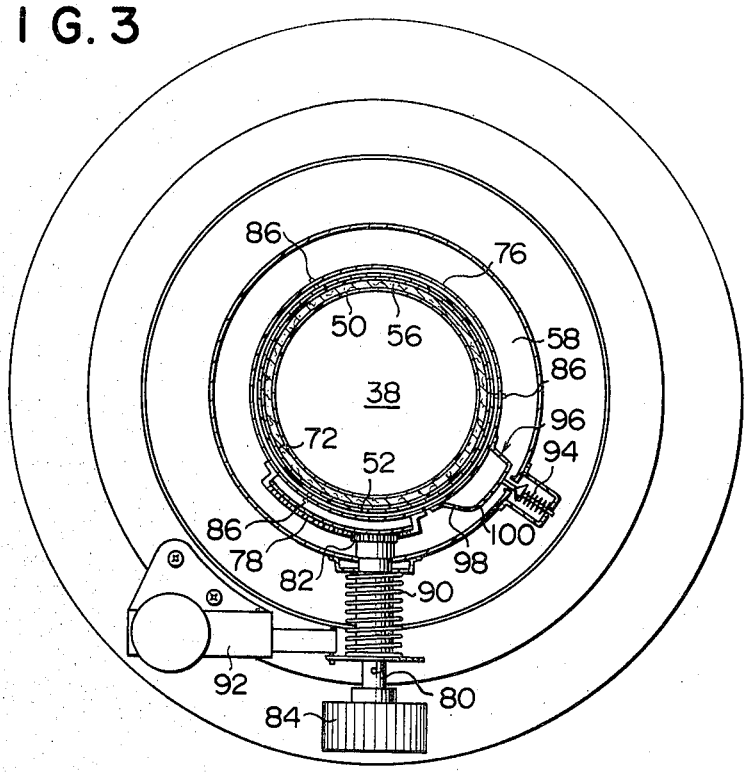
FIG. 3 is a transverse sectional view taken substantially along line III—III of FIG. 1.
Figure 4:
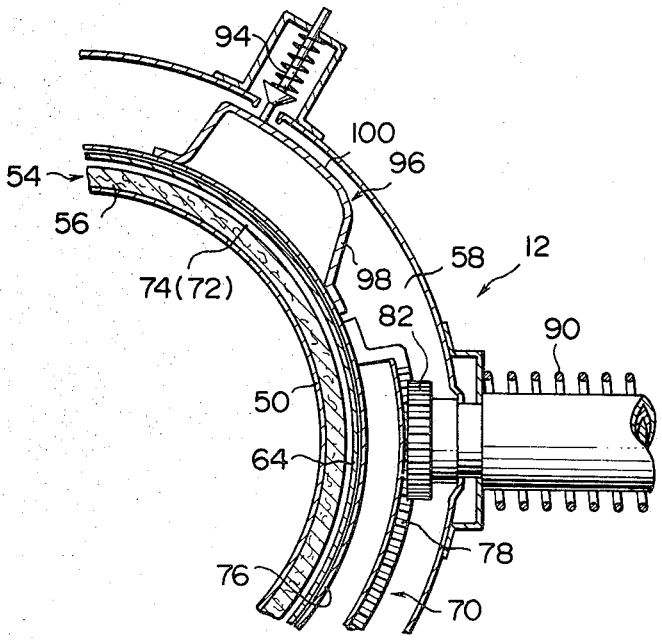
FIG. 4 is an enlarged detailed partial view of FIG. 3.

The fire extinguishing device 12 according to the present invention includes a portion of the wick receiving cylinder 16 and is adapted to be disposed adjacent to the wick receiving cylinder, as schematically illustrated in FIG. 1 and detailedly illustrated in FIGS. 2 to 4. The wick receiving cylinder 16 has an inner wall 50 and an outer wall 52 which define an annular chamber 54 for receiving a wick 56 communicated to the combustion chamber 28, as shown in FIGS. 2 and 4. When the oil burner is subjected to the combustion operation, the wick 56 is raised to the lower portion of the combustion chamber, as explained in detail hereinafter. FIG. 1 shows the state that the oil burner is subjected to the combustion operation, while, FIG. 3 shows the state that the oil burner is subjected to the fire extinguishing operation or is not used for combustion. It should be noted that the wick receiving chamber 54 is constructed to have a space 55 having a width d larger than the thickness t of the wick 56 (FIG. 2).

The wick receiving chamber 54 is provided therearound an annular air chamber 58 having an annular opening 60 through which the air chamber is communicated to the wick receiving chamber 54. The opening 60, as shown in FIGS. 1 and 2, is provided at the portion of the air chamber somewhat higher than a top end of the wick 56 when the wick has been lowered into the wick receiving chamber 54 for the fire extinguishing of the oil burner. In the embodiment illustrated in the drawings, the air chamber 58 is formed by an upper and lower wall members 62 and 64 of the outer wall 52 of the wick receiving chamber. More particularly, the upper wall member 62 has an enlarged portion 66 at the lower portion thereof and the lower wall member 64 is formed to be fitted to the enlarged portion 66 of the upper wall member, to thereby define the air chamber 58 therebetween. And, the opening 60 is provided at the top portion of the lower wall member 64. It is preferable that the size of the opening 60 is determined to supply an air sufficient to extinguish the fire of the oil burner when the wick 56 has been lowered into the wick receiving chamber 54, as explained hereinafter in detail. In addition, in the embodiment illustrated, an annular space 68 is provided between the horizontally extending portion of the upper wall member 62 and the top portion of the lower wall member 64 which allows fuel oil contained in the wick 56 to easily flow into the air chamber therethrough when overturning the oil burner by mistake.

Reference numeral 70 designates a means for actuating the wick 56 supported by an annular retaining plate 72 which is disposed between the wick and the lower wall member 64 of the outer wall 52 of the wick receiving chamber 54 to lightly press the wick against the inner wall 50 of the wick receiving chamber. Accordingly, it should be noted that a gap 74 is constantly formed between the wick 56 and the outer wall 52 of the wick receiving chamber 54, because the space 55 has a width d larger than the thickness t of the wick 56; thus, even when the wick is raised to the lower portion of the combustion chamber 28 for the combustion operation, the air chamber 58 is adapted to be communicated through the opening 60 and the gap 74 to the combustion chamber 28. The wick actuating means 70 is constructed in such a manner as widely known in the art, except that it is substantially received in the air chamber 58 for the purpose of compacting the whole oil burner structure. That is, the wick actuating means 70 comprises an annular plate 76 for rotating the wick retaining plate 72 which is provided outside the outer wall 52 of the wick receiving chamber 54 and is adapted to move in the circumferential direction; a rack 78 attached to the plate 76; and a rotating shaft 80 having at one end thereof a pinion 82 engaging with the rack 78 and at the other end thereof a knob 84. The connection between the wick retaining plate 72 and the actuating plate 76 is effected by pins 86 extending through inclined grooves 88 provided at the lower wall member 64 and inclined grooves 89 provided at the actuating plate 76 which obliquely cross each other, and fixed to the wick retaining plate 72. The operation of raising and lowering the wick 56 by such means is widely known in the art. The grooves 88 and 89 also serve to discharge therethrough to the wick receiving chamber 56 fuel oil flowing along the wick into the air chamber 58 due to the overturning of the oil burner by mistake. However, such discharge means may be provided separately from the grooves 88 and 89.

Reference numeral 90 indicates a return spring which is adapted to actuate due to vibration such as an earthquake to rapidly rotate the shaft 80 in the direction of lowering the wick. Under normal conditions, the return spring 90 is adapted to be prevented from actuating by a lock means 92.

As detailedly shown in FIGS. 3 and 4, the air chamber 58 is provided at the outside thereof with a valve means 94 which allows the air chamber 58 to be communicated therethrough to an ambient atmosphere when opening. The valve means 94 is adapted to engage with a projection member 96 mounted on the actuating plate 76 rotated by the shaft 80 adjacent to the rack 78 and to be actuated corresponding to the movement of the wick 56. More particularly, the valve means 94 is adapted to engage with the slanting portion 98 of the member 96 to close when the actuating plate 76 is rotated to lower the wick 56 into the wick receiving chamber 54, and to engage with the projecting portion 100 of the member 96 to open when the wick 56 is raised to the lower portion of the combustion chamber 28 for the combustion operation. The air chamber 58 is constructed to be shut off from an ambient atmosphere except the valve means 94.

The manner of operation of the fire extinguishing device of the present invention described in connection with the drawings will now be explained.

As mentioned above, the fire extinguishing device of the present invention is constructed in such manner that the space 55 of the wick receiving chamber 54 has a width larger than the thickness of the wick 56. Therefore, during the combustion operation, a draft effect due to flame within the combustion chamber 18 influences the air chamber 58 through the gap 74 and the opening 60. In addition, the valve means 94 opens during the combustion operation. Thus, an ambient atmosphere is introduced from the valve means through the air chamber to the combustion chamber. This results in the air chamber being always filled with a fresh air during the combustion operation, even when the air chamber also serves as a chamber for receiving the wick actuating means 70 and a chamber for receiving fuel oil leaking at the overturning of an oil burner.

Then, when the shaft 80 is rotated by hand or by the return spring 90 for the purpose of conducting the fire extinguishing operation, the valve means 94 is closed to shut off the air chamber 58 from an ambient atmosphere, and simultaneously the wick 56 is lowered to the position below the opening 60. By the way, the air chamber 58 and the wick receiving chamber 54 is constantly cooled to a temperature near a room temperature; because, during the combustion operation, a fresh air has been constantly introduced into the air chamber and has constantly flowed through the gap 74. Thus, the amount of fuel oil vapor generating from the wick is reduced because of being cooled by the wick receiving chamber. In addition, the flame of the wick 56 is drawn in the wick receiving chamber corresponding to the lowering of the wick to consume oxygen received in the air chamber 58 to produce incombustible gas. The operation of lowering the wick 56 also causes the occurrence of turbulent flow in the wick receiving chamber, this resulting in fuel oil vapor from the wick 56 being diffused into the air chamber 58. Thus, fuel oil vapor within the portion of the wick receiving chamber adjacent to the opening 60 is diluted by an air within the air chamber and the produced incombustible gas to become incombustible. Such action begins simultaneously with the wick lowering operation.

The wick receiving chamber 54, as mentioned above, is not communicated to an ambient atmosphere during the fire extinguishing operation; therefore, in order that fuel oil vapor within the space 55 continues to burn, it is necessary to introduce an air from the top portion of the wick receiving chamber 54 thereinto. However, flame remaining in the portion of the wick receiving chamber above the opening 60 of the air chamber 58 is shut off from fuel oil generated from the wick 56 by the diluted fuel oil vapor phase mentioned above, therefore, the remaining flame burns out without igniting the fuel oil vapor. And then, the wick receiving chamber 54 is filled with fuel oil vapor generated from the wick 56 because the air chamber 58 is closed, and the fuel oil vapor reaches the combustible range. However, the remaining flame, as mentioned above, has perfectly burned out, therefore, no ignition of the fuel oil vapor occurs.

In the embodiment illustrated in the drawings, the air chamber 58 is constructed to also serve as a chamber for receiving the wick actuating means 70 for the purpose of simplifying an oil burner structure. When the air chamber 58 has such function as well, it becomes substantially impossible to prevent fuel oil vapor generated from the wick from entering the air chamber during the fire extinguishing operation. Therefore, in order to allow the air chamber to surely achieve its primary function, it is required to introduce a fresh air from the valve means 94 through the air chamber and the gap 74 to the combustion chamber 28 during the combustion operation. In such case, it is necessary to take care to prevent a great volume of air from entering the lower portion of the combustion chamber which is filled with fuel oil vapor generated from the wick 56.

Thus, it becomes substantially impossible to combine the fire extinguishing device of the present invention with a conventional one constructed to provide a wick receiving chamber with small holes as disclosed in Japanese Utility Model Publication No. 47225/1974. The reason is that in the present invention the space 55 between the inner and outer walls 50 and 52 of the wick receiving chamber is larger in width than the thickness of the wick 56, therefore, if the wick receiving chamber 56 is provided with such small holes as disclosed in the prior art, an air is substantially introduced from the holes because such holes have a small flow resistance as compared with the flow passage including the air chamber 58; this resulting in the air chamber being filled with fuel oil vapor having a high concentration.

While, when the wick receiving chamber 54 of the device of the present invention is provided with such small holes constructed to be opened only at the fire extinguishing operation, the air chamber 58 is filled with a fresh air during the combustion operation. However, during the fire extinguishing operation, it is substantially impossible to keep the above mentioned diluted fuel oil vapor phase within the upper portion of the wick receiving chamber 54 stable and thick, because an air is introduced from the holes. Thus, it becomes very difficult to surely and instantaneously achieve the fire extinguishing of an oil burner.

The fire extinguishing device of the present invention, as mentioned above, is constructed so that the wick receiving chamber 54 is not communicated to an ambient atmosphere during the fire extinguishing operation; therefore, fuel oil vapor within the wick receiving chamber 54 cannot be introduced to the combustion chamber 28 still kept at a high temperature, even if the combustion chamber still has a draft effect. Thus, it should be noted that the device of the present invention does not cause bad odor to be generated. In addition, the air chamber 58 does not substantially contain fuel oil vapor and is filled with an air at the beginning of fire extinguishing operation; therefore, fuel oil vapor generated from the wick 56 during the fire extinguishing operation is firstly introduced into the air chamber 58 because the fuel oil vapor is heavier than an air, and then, the wick receiving chamber 54 is filled with the vapor. However, at this time, the combustion chamber is sufficiently cooled, so that the vapor may not be subjected to thermal decomposition. Thus, the device of the present invention does not cause bad odor to be generated.

As mentioned above, the fire extinguishing device according to the present invention is constructed so that the supply of an air to the air chamber 58 during the combustion operation may be conducted by utilizing the draft effect of flame within the combustion chamber, thus, it should be understood that the device of the invention is applicable to various types of oil burners.

As many apparently widely different embodiments of this invention may be made without departing from the spirit and scope thereof, it is to be understood that the invention is not limited to the specific embodiment thereof except as defined in the appended claims.

What is claimed is:

1. A fire extinguishing device for an oil burner comprising:

a wick receiving chamber having a width larger than the thickness of a wick received therein;

an air chamber disposed adjacent to said wick receiving chamber and having an opening communicated to said wick receiving chamber; and a valve means provided at said air chamber, said valve means being actuated corresponding to the movement of said wick so as to allow said air chamber to be communicated therethrough to an ambient atmosphere when raising said wick and to allow said air chamber to be shut off from an ambient atmosphere when lowering said wick.

2. A fire extinguishing device for an oil burner as defined in claim 1 further comprising a means for actuating said wick, said wick actuating means being substantially received in said air chamber.

3. A fire extinguishing device for an oil burner as defined in claim 1 further comprising a means for automatically extinguishing the fire of said oil burner.

4. A fire extinguishing device for an oil burner as defined in claim 1 wherein a space is provided between said wick receiving chamber and said air chamber and adjacent to said opening of said air chamber, said wick receiving chamber and said air chamber being communicated to each other through said space and said opening.

5. A fire extinguishing device for an oil burner as defined in claim 4 wherein said air chamber is provided at the lower portion thereof with at least one hole communicated to said wick receiving chamber.

* * * * *